United States Patent [19]

Podbury et al.

[11] Patent Number: 4,845,601

[45] Date of Patent: Jul. 4, 1989

[54] ILLUMINATION/VENTILATION SYSTEM AND TRACK LIGHT FIXTURE

[75] Inventors: John A. Podbury, Epping; Dennis E. Leech, London, both of England

[73] Assignee: Display Lighting Systems, San Antonio, Tex.

[21] Appl. No.: 97,743

[22] Filed: Sep. 17, 1987

[30] Foreign Application Priority Data

Sep. 19, 1986 [GB] United Kingdom ..... 8622597

[51] Int. Cl.[4] ..... F21V 29/00

[52] U.S. Cl. ..... 362/125; 362/294; 362/373; 362/226; 362/285; 439/619; 439/110

[58] Field of Search ..... 362/96, 125, 126, 245, 362/247, 249, 150, 294, 373, 285, 418, 430, 217, 250, 218, 220, 149; 439/110–122, 336, 356, 619; 312/223, 114

[56] References Cited

U.S. PATENT DOCUMENTS

| | | | |
|---|---|---|---|
| 2,338,077 | 12/1943 | Scribner | 362/218 |
| 2,351,335 | 6/1944 | Holmes | 362/125 |
| 2,559,371 | 7/1951 | Ressinger | 362/125 |
| 2,569,934 | 10/1951 | Kurtzon | 362/125 |
| 2,641,687 | 6/1953 | Akely | 362/218 |
| 2,960,602 | 11/1960 | Kurth et al. | 362/218 |
| 3,065,686 | 11/1962 | Geocaris | 98/40.09 |
| 3,215,828 | 11/1965 | Bonvallet et al. | 362/218 |
| 3,391,377 | 7/1968 | Corl et al. | 439/121 |
| 3,639,885 | 2/1972 | Yoshiya et al. | 439/118 |
| 3,751,653 | 8/1973 | Henry | 362/126 |
| 3,832,503 | 8/1974 | Crane | 439/110 |
| 3,846,072 | 11/1974 | Patterson | 422/121 |
| 3,864,006 | 2/1975 | Feldner | 439/619 |
| 4,137,424 | 1/1979 | Hesse et al. | 174/97 |
| 4,158,221 | 6/1979 | Agabekov | 362/219 |
| 4,414,617 | 11/1983 | Galindo | 362/404 |
| 4,507,714 | 3/1985 | Aschirper et al. | 362/125 |
| 4,521,838 | 6/1985 | Agabekov | 362/219 |
| 4,535,393 | 8/1985 | Aspenwall | 362/217 |
| 4,569,568 | 2/1986 | Agabekov | 339/20 |
| 4,598,341 | 7/1986 | Brackhahn et al. | 362/125 |
| 4,628,421 | 12/1986 | Saar | 362/249 |
| 4,748,545 | 5/1988 | Schmitt | 362/226 |

FOREIGN PATENT DOCUMENTS

| | | | |
|---|---|---|---|
| 3151996 | 7/1983 | Fed. Rep. of Germany | 439/110 |
| 787879 | 7/1935 | France | 362/126 |

*Primary Examiner*—Ira S. Lazarus
*Assistant Examiner*—D. M. Cox
*Attorney, Agent, or Firm*—Harold E. Meier

[57] ABSTRACT

An illumination/ventilation system is described wherein the light tube used to support one or more incandescent lamps forms part of the ventilation system itself. The system includes a blower having a forced air outlet with first a conduit connectings the outlet of the blower to an inlet of the light tube. A second conduit connects to an outlet of the light tube to form a circulating air path through which air is forced by the blower to ventilate the light tube. Preferably, the light tube comprises an elongate base member and an elongate light diffuser for supporting the lamps along the light tube. The light tube also includes an elongate track member having a tongue along its entire length which mates which a groove along the length of the base member to secure the track in the base member. Each of the individual lamps is supported in the elongate track member by an adapter track clip which is press-fitted, rather than twisted, into the track.

28 Claims, 2 Drawing Sheets

ILLUMINATION/VENTILATION SYSTEM AND TRACK LIGHT FIXTURE

TECHNICAL FIELD

The present invention relates generally to lighting systems and particularly to an illumination/ ventilation system and an improved track light fixture therefor.

BACKGROUND OF THE INVENTION

Existing display cases normally rely on fluorescent illumination because incandescent illumination causes the air within the case to overheat, precluding display of delicate merchandise such as cosmetics and perfumes. The heated air produced as a result of traditional illumination of display cases by incandescent illumination also radiates to the structural elements of the display case, making the case uncomfortable for either a salesperson or customer to lean on to view the displayed merchandise. Moreover, prior art display lighting systems which do use incandescent illumination typically support the lamps in a 'track' fixture. In such systems, the lamps are twisted into the track member and a special fitting is required to secure the track member to the remainder of the fixture. Such prior art systems are often costly and difficult to install and maintain.

There is therefore a need for a display lighting system which facilitates the use of incandescent illumination in a display case and which obviates several disadvantages associated with prior art track lighting fixtures.

BRIEF SUMMARY OF THE INVENTION

An illumination/ventilation system for a display case is described comprising a light tube mounted in the case and having an inlet and an outlet. The light tube supports one or more incandescent lamps along its length. A blower is mounted to the display case and includes a forced air outlet. In the preferred embodiment, a first conduit is supported by or embedded in a sidewall of the display case and connects the outlet of the blower to the inlet of the light tube. A second conduit, preferably supported by or embedded in an opposing sidewall, is connected to the light tube outlet to form an air path through which air is forced by the blower to ventilate the light tube and the display case. The outlet of the second conduit is preferably located in or adjacent a base portion of the display case.

According to another feature of the invention, the light tube includes an elongate base member, having a groove along substantially its entire length, and an elongate track member having a tongue along substantially its entire length. The tongue of the elongate track member cooperates with the groove of the elongate base member to secure the track and the base member together. The track member supports first and second electrically-conductive strips through which current is supplied to one or more incandescent lamps supported in the tube. The light tube also includes an elongate light diffuser lens supported by the base member to form a substantially closed channel through which air flows over the incandescent lamps for ventilation. The diffuser lens softens and directs the light evenly throughout the display case. Preferably, the diffuser lens and the track member are formed of polycarbonate materials to minimize heat damage from the incandescent lamps.

According to yet another feature of the invention, each of the incandescent lamps includes a light bulb supported on a track adapter clip which is 'press-fitted,' rather than twisted, into the elongate track member of the light tube. Typically, each light bulb is supported in the adapter clip by a ceramic lamp holder having electrically-conductive prongs. The track adapter clip includes a body portion having first and second supports for supporting the electrically-conductive prongs of the lamp holder. Electrically-conductive plates are secured around the first and second supports and are maintained in electrical contact with the electrically-conductive prongs of the lamp holder by an insulating clip cover. Each of the electrically-conductive plates includes one or more raised contact portions which facilitate the press-fit of the clip into the track member. The raised contact portions also insure that electrical continuity between the track member and the lamp is maintained at all times. The track adapter clip also includes an integral reflector for directing the light towards the display case merchandise.

BRIEF DESCRIPTION OF THE DRAWINGS

For a more complete understanding of the present invention and the advantages thereof, reference is now made to the following Description taken in conjunction with the accompanying Drawings in which.

DETAILED DESCRIPTION

Figure 1:
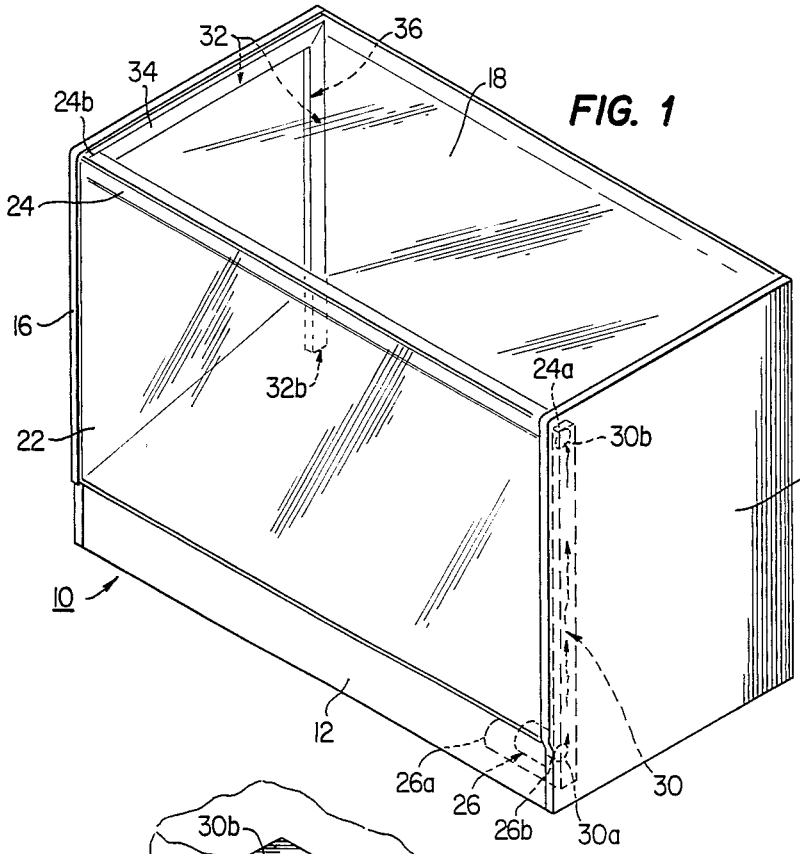
FIG. 1 is a perspective view of a display case incorporating the illumination/ventilation system of the present invention.

Referring now to the drawings wherein like reference characters designate like or similar parts throughout the several views, FIG. 1 is a perspective view of a display case 10 incorporating the illumination/ventilation system of the present invention. Display case 10 is of conventional design and includes a base portion 12, first and second vertical sidewall portions 14 and 16, and top counter portion 18. The display case 10 may also include one or more shelves (not shown) on which merchandise to be displayed is supported. Display glass 22 is supported by the base portion 12 and the first and second vertical sidewall portions 14 and 16 adjacent a front portion of the display case 10. Although not shown, the rear opening of the display case 10 typically includes one or more sliding glass doors or other similar partitions.

The display case 10 also includes a light tube 24 for supporting one or more incandescent lamps for use in illuminating the merchandise displayed in the case. Prior art display cases normally rely on fluorescent illumination because incandescent illumination causes the air within the display case 10 to overheat, precluding display of delicate merchandise. This heat also radiates to the structural elements of the case. To overcome these and other problems associated with prior art display cases using fluorescent illumination, case 10 of the present invention includes an illumination/ventilation system described below.

Specifically, the illumination/ventilation system of the present invention includes a blower or fan unit 26 supported by the display case 10 and having an air inlet 26*a* and a forced air outlet 26*b*. Air inlet 26*a* receives ambient air and the blower 26 forces this air out of the outlet 26*b*. Blower outlet 26*b* is connected via a flexible gasket (not shown) to a first conduit 30 having an inlet 30*a* and an outlet 30*b*. The first conduit 30 is surface-mounted against the first vertical sidewall 14 by any convenient fastening means. The conduit 30 may likewise be semi-recessed or fully embedded in the first sidewall 14. Conduit 30 may also be independently suspended away from the sidewall if desired. The outlet 30*b* of the conduit 30 is connected to an inlet 24*a* of the light tube 24 by a suitable fastening means to create an air path from the blower, through the first conduit 30, and through the light tube 24.

As also seen in FIG. 1, the illumination/ ventilation system of the invention includes a second conduit 32 having an inlet 32*a* and an outlet 32*b*. Preferably, the second conduit 32 comprises two portions, a horizontal section 34 connected to the light tube outlet 24*b* and located adjacent the top counter portion 18 of the display case 10, and a vertical section 36 connected to the horizontal section 34. The vertical section 36 includes the outlet 32*b* of the conduit 32 adjacent to or in the base portion 12 of the display case 10. The second conduit 32, alternatively, comprises a one-piece vertical tube supported by or otherwise embedded in the second vertical sidewall 16. Conduits 30 and 32 cooperate with the light tube 24 to form a closed air path through which air is forced by the blower 26 around the incandescent lamps in the tube to thereby ventilate the light tube and thus the display case. In particular, heat associated with the lamps is transferred to the air to hold a lower temperature in the case, and the heated air is then circulated away from the lamps and exhausted from the case.

It should be appreciated that the structure of the illumination/ventilation system in conjunction with the display case 10 as shown in FIG. 1 is not meant to be limiting. For example, the blower 26 may be located in any convenient location in the display case, and the conduits used to provide a circulating flow path through the light tube 24 may likewise be located in any convenient location depending on the aesthetics and the structure of the display case. Moreover, although the light tube 24 is shown adjacent the display glass 22 and the top portion 18 of the case 10, one or more such light tubes (and associated airflow conduits and blowers) may be provided in other locations within the display case within the scope of the present invention. Moreover, while it is preferred to exhaust the heated air adjacent the base portion of the display case, other arrangements are well within the scope of the present invention.

Figure 2:
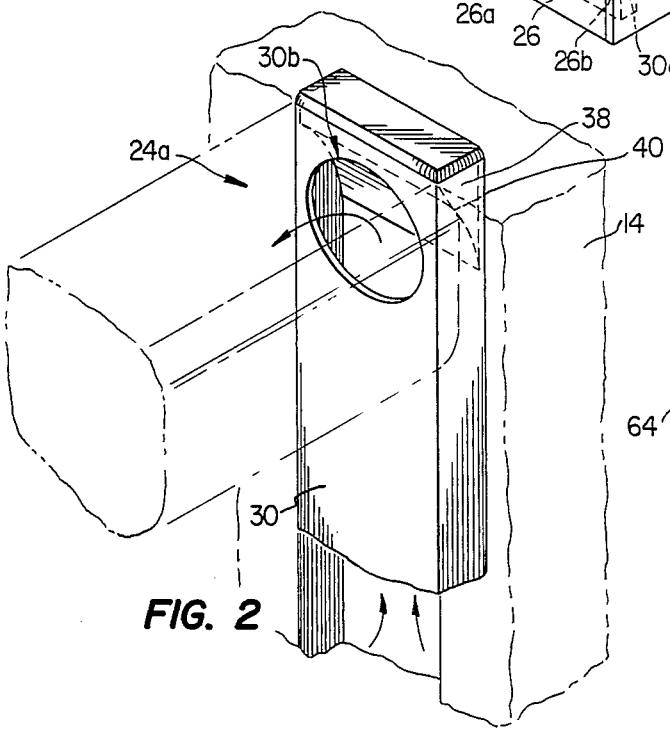
FIG. 2 is a perspective view of a portion of the illumination/ventilation system of FIG. 1.

Referring now to FIG. 2, a perspective view is shown of a portion of the illumination/ventilation system of the invention of FIG. 1. It should be appreciated that FIG. 2 is a modification of FIG. 1 to the extent that it shows the first conduit 30 embedded within the first vertical sidewall 14 rather than being surface-mounted on the sidewall 14. As seen in FIG. 2, the first conduit 30 includes a substantially circular outlet 30*b* through which air being circulated in the air path is directed into the light tube 24 via inlet 24*a*.

According to another feature of the invention, the first conduit 30 includes a shaped end stop 38 for facilitating the change of direction of the airflow from the (vertical) conduit 30 to the (horizontal) light tube 24. As seen in FIG. 2, the shaped end stop 38 includes a curved surface 40 so as to obviate an otherwise 90° change of direction of the airflow. Although not shown in detail, it should be appreciated that each of the conduit portions of the illumination/ ventilation system include similar shaped end stops strategically located wherever the direction of the airflow must be changed. Accordingly, one such shaped end stop is located adjacent the inlet 30*a* of the conduit 30 for changing the direction of the airflow output from the blower 26. Such stops are also used between the horizontal vertical sections 34 and 36 of the second conduit 32 as well as adjacent the inlet 32*a* of the second conduit.

Figure 3:
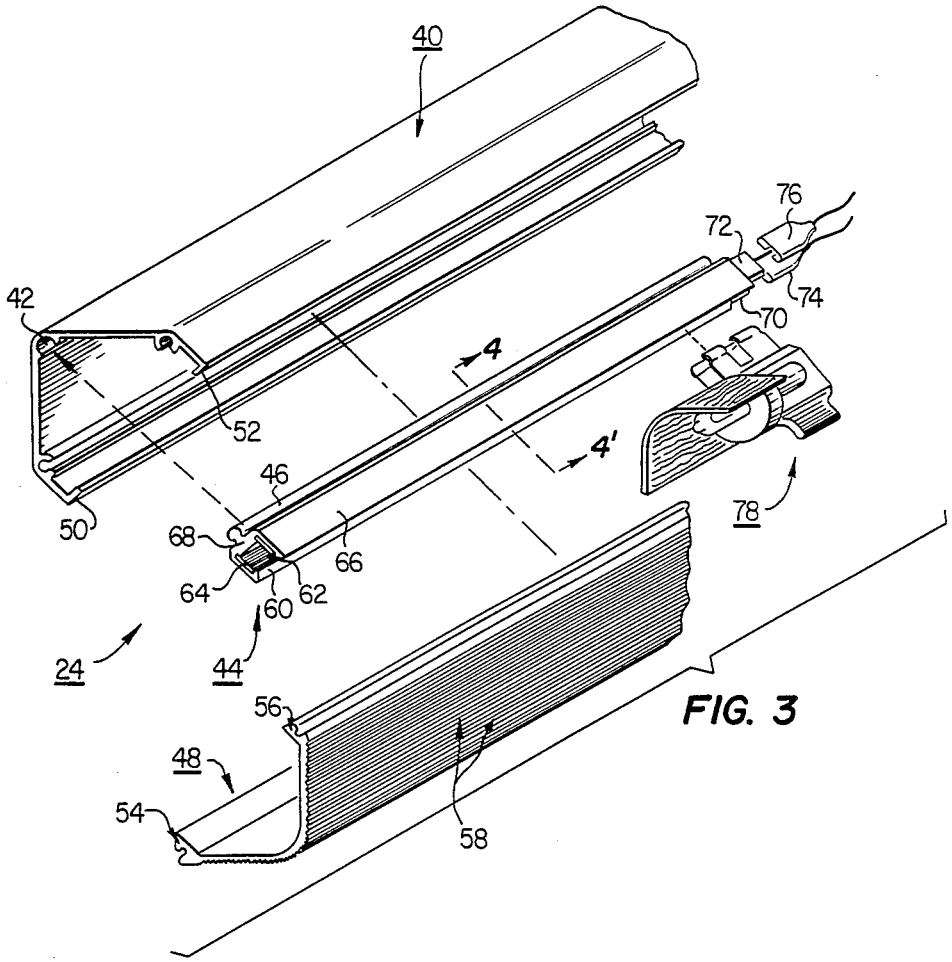
FIG. 3 is an exploded view of a portion of the light tube of FIG. 1 showing the details of the track lighting fixture of the invention.

Referring now to FIG. 3, an exploded view is shown of the preferred structure of the light tube 24 of the present invention. As described above, the light tube forms a portion of the illumination/ ventilation system used to illuminate and ventilate the display case. In the preferred embodiment, the light tube 24 comprises an elongate base member 40 having a groove 42 along substantially its entire length. Light tube 24 also includes an elongate track member 44 having a tongue 46 along substantially its entire length. The tongue 46 of the track member 44 cooperates with the groove 42 of the base member 40 to secure the track member 44 and the base member 40 together. The light tube 24 further includes an elongate diffuser lens 48 supported by the base member 40 to form a substantially closed channel in the light tube 24 through which air is forced by the blower as described above.

As seen in FIG. 3, the base member 40 has a substantially V-shaped cross-section and includes first and second flange portions 50 and 52 along substantially its entire length. Likewise, the diffuser lens 48 has a substantially V-shaped cross-section and includes first and second flange portions 54 and 56 along substantially its entire length. The first flange portions and the second flange portions of the base member 40 and the diffuser lens 48 cooperate to secure the diffuser lens 48 to the base member 40. In the preferred embodiment, the diffuser lens is formed of a polycarbonate material to avoid meltdown or damage by heat. The diffuser lens 48 advantageously softens the illuminated light and distributes this light evenly throughout the display case 10. To this end, the diffuser lens 48 includes a "reeded" surface comprising a plurality of parallel longitudinal ridges 58 substantially as shown in FIG. 3.

Figure 4:
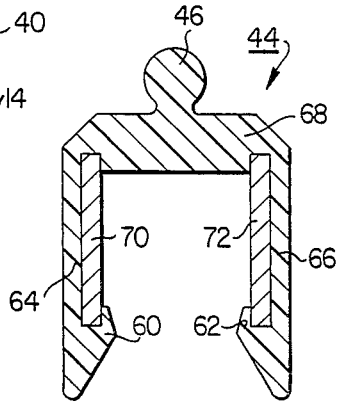
FIG. 4 is a cross-sectional view along line 4—4' of the elongate track member of the light tube of FIG. 3.

As also seen in FIG. 3, the track member 44 has a substantially U-shaped cross-section and includes first and second arm portions 60 and 62 which extend inwardly from first and second legs 64 and 66, respectively. The track member 44 has a base 68 integrally connected to the tongue 46. This structure is best shown in FIG. 4, which is a cross-sectional view of the track member 44 along line 4—4' of FIG. 3. Like the diffuser lens 48, the track member 44 is made of a polycarbonate material to avoid heat damage. Each of the first and second inwardly-extending arm portions 60 and 62 of the track member 44 supports a copper electrode 70 and 72, respectively, through which current is supplied to the one or more lamps supported the light tube 24.

Referring back to FIG. 3, flat push-on connectors 74 and 76 are connected to the copper electrodes 70 and 72, respectively, to provide the current path. Significantly, because electrical current is supplied from only one end of the light tube, the display illumination system may be cut at any point without being disassembled. As described above, the light tube 24 supports one or more lamps, each of such lamps designated generally by the reference numeral 78. Each lamp 78 is preferably "press-fitted" into the track member 44 in a manner to be described below.

Figure 5:
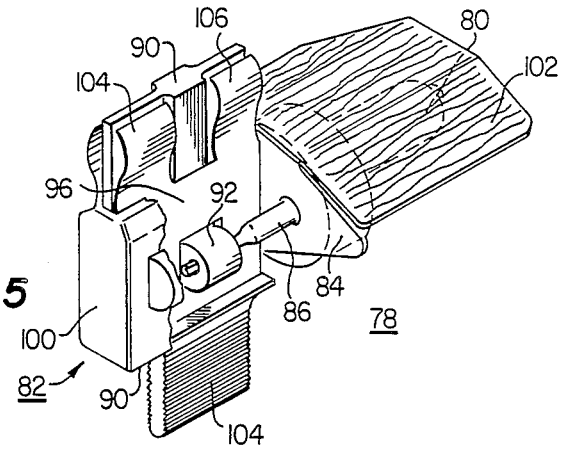
FIG. 5 is a perspective view, partially cutaway, of a lamp for use in conjunction with the track lighting fixture of FIGS. 3 and 4.

Referring now to FIG. 5, a perspective view is shown of one of the lamps 78 for use in conjunction with the track lighting fixture of FIG. 3. As seen in FIG. 5, the lamp 78 comprises a light bulb 80, preferably a halogen or other type of incandescent bulb, and a track adapter clip 82. Adapter clip 82 includes a lamp holder 84, preferably ceramic, for use in supporting the light bulb 80. Lamp holder 84 is of conventional design and includes first and second electrically-conductive prongs through which current is supplied to the bulb 80. Only the first prong 86 is shown in the perspective view. The adapter clip 82 also includes a body portion 90 having first and second supports for supporting the first and second electrically-conductive prongs, respectively, of the lamp holder 84. Only the first support 92 is shown in the perspective view. The adapter clip 82 also includes first and second electrically-conductive plates, with only first plate 96 being shown, secured around the first and second supports, respectively, of the body portion 90. An insulating cover clip 100, partially cutaway, is provided to maintain the first and second electrically-conductive prongs in secure electrical contact with the first and second electrically-conductive plates, respectively. The adapter clip 82 also includes a reflector 102 for directing light away from the light bulb. Finally, body portion 90 includes an integral extension 104 so that the lamp can be held and easily 'press-fitted' into the track member 44 of the light tube 24 as described above. As also seen in FIG. 5, each of the first and second electrically-conductive plates of each lamp 78 include one or more raised contact portions 104 and 106 to enable the lamp 78 to be press-fitted and maintained in the track member 44 of FIG. 4.

Although the invention has been described in detail, it is to be clearly understood that the same is by way of illustration and example only and is not to be taken by way of limitation. The spirit and scope of this invention are to be limited only by the terms of the appended claims.

What is claimed:

1. An illumination/ventilation system for a display case comprising:

a hollow, enclosed light tube mounted in the display case and having an inlet and an outlet, the light tube including means for supporting one or more lamps interior of and along its length;

a blower supported by the display case and having a forced air outlet; and conduit means supported in the display case and including a first portion and a second portion each having an inlet and an outlet, the first portion connected between the blower outlet and the enclosed light tube inlet and the second portion connected to the enclosed light tube outlet to form an enclosed air path through which air is forced by the blower to ventilate the light tube and expel heat generated by said lamps.

2. The illumination/ventilation system as described in claim 1 wherein the first and second portions of the conduit means are embedded in vertical sidewall portions of the display case.

3. The illumination/ventilation system as described in claim 1 wherein the second portion of the conduit means includes an outlet adjacent a base portion of the display case.

4. The illumination/ventilation system as described in claim 1 wherein the outlet of the first portion and the inlet of the second portion of the conduit means each include means for changing the direction of airflow through the air path.

5. The illumination/ventilation system as described in claim 1 wherein the blower outlet is attached to the inlet of the first portion of the conduit means and further including means adjacent the inlet of the first portion for changing the direction of the airflow through the air path.

6. The illumination/ventilation system as described in claim 1 wherein the second portion of the conduit means includes a horizontal section connected to the light tube outlet and a vertical section connected to the horizontal section, the vertical section having an outlet adjacent a base portion of the display case.

7. An illumination/ventilation system for a display case, comprising:

a light tube mounted in the display case and having an inlet and an outlet, the light tube for supporting one or more lamps along its length, the light tube comprising:

an elongate base member having a groove along substantially its entire length;

an elongate track member having a tongue along substantially its entire length, the tongue of the track member cooperating with the groove of the base member to secure the track to the base member; and an elongate diffuser supported by the base member to form a substantially closed channel in the light tube.

a blower supported by the display case and having a forced air outlet; and conduit means supported in the display case and including a first portion and a second portion each having an inlet and an outlet, the first portion connected between the blower outlet and light tube inlet and the second portion connected to the light tube outlet to form an air path through which air is forced by the blower to ventilate the light tube.

8. The illumination/ventilation system as described in claim 7 wherein the base member has a substantially V-shaped cross-section and includes first and second flange portions along substantially its entire length.

9. The illumination/ventilation system as described in claim 8 wherein the diffuser has a substantially V-shaped cross-section and includes first and second flange portions along substantially its entire length, the first flange portions and the second flange portions of the base member and the diffuser cooperating to secure the diffuser to the base member.

10. The illumination/ventilation system as described in claim 7 wherein the track member has a substantially U-shaped cross-section and includes first and second leg portions and first and second arm portions, respectively, inwardly extending from said first and second leg portions.

11. The illumination/ventilation system as described in claim 10 wherein each of the arm portions of the track member supports an electrical conductor.

12. The illumination/ventilation system as described in claim 10 wherein each of said lamps comprises:

a light bulb;

a lamp holder for supporting the light bulb and having first and second electrically-conductive prongs;

a body portion having first and second supports for supporting the first and second electrically-conductive prongs, respectively, of the lamp holder;

first and second electrically-conductive plates secured around the first and second supports, respectively, of the body portion for making contact with said electrical conductors supported in the first and second arm portions;

an insulating cover clip for maintaining the first and second electrically-conductive prongs in electrical contact with the first and second electrically-conductive plates, respectively; and a reflector for directing light from the light bulb.

13. The illumination/ventilation system as described in claim 12 wherein the first and second electrically-conductive plates each include one or more raised contact portions to enable the lamp to be press-fitted into the track member.

14. An illumination/ventilation system for a display case comprising:

a hollow, enclosed light tube mounted adjacent a top portion of the display case and having an inlet and an outlet, the light tube including means for supporting one or more lamps on its interior and along its length;

a blower supported by the display case and having an inlet and a forced air outlet;

conduit means imbedded in the display case and including a first portion and a second portion each having an inlet and an outlet, the first portion connected between the blower outlet and the enclosed light tube inlet and the second portion connected to the enclosed light tube outlet to form an enclosed air path through which air is forced by the blower to ventilate the light tube and expel heat generated by said lamps; and means supported in the first and second portions of the conduit means for changing the direction of the air flow through the air path.

15. The illumination/ventilation system as described in claim 14 wherein the means for changing the direction of the airflow includes a shaped end stop adjacent each inlet and outlet of the first and second portions of the conduit means.

16. The illumination/ventilation system as described in claim 14 wherein the light tube comprises:

an elongate base member of substantially V-shaped cross-section and having a groove along substantially its entire length;

an elongate track member of substantially U-shaped cross-section and having a tongue along substantially its entire length, the tongue of the track member cooperating with the groove of the elongate base member to secure the track to the base member; and an elongate light diffuser of substantially V-shaped cross-section and supported by the base member to form a substantially closed channel in the light tube through which air is forced by the blower.

17. The illumination/ventilation as described in claim 16 wherein the base member and the light diffuser each include first and second flange portions along substantially their entire length, the first flange portions and the second flange portions of the base member and the light diffuser cooperating to secure the diffuser to the base member.

18. The illumination/ventilation system as described in claim 16 wherein the track member includes first and second leg portions and first and second arm portions, respectively, inwardly extending from said first and second leg portions.

19. The illumination/ventilation system as described in claim 18 wherein each of the arm portions of the track member supports an electrical conductor.

20. A lamp for press-fit use in a track lighting fixture, comprising:

a light bulb;

a lamp holder for said light bulb, said holder having first and second electrically-conductive prongs;

a body portion having first and second supports for supporting the first and second electrically-conductive prongs, respectively, of the lamp holder;

first and second electrically-conductive plates secured around the first and second supports, respectively of the body portion; and an insulating cover clip surrounding said first and second supports and between said first and second conductive plates to hold said first and second plates apart for maintaining the first and second electrically-conductive prongs in electrical contact with the first and second electrically-conductive plates, respectively.

21. The lamp as described in claim 20 wherein the first and second electrically-conductive plates each include one or more raised contact portions to enable the lamp to be press-fitted into the track lighting fixture.

22. The light fixture as described in claim 20 further including a reflector for directing light away from the light bulb.

23. A lighting system, comprising:

a light tube comprising an elongate substantially V-shaped base member, having a single groove along substantially its entire length, and a single elongate track member, having a continuous integrally formed tongue along substantially its entire length, the tongue of the track member in a press-fit cooperating with the groove of the base member as the sole means to secure the track to the base member; and one or more lamps each including a light bulb and means for supporting the light bulb in the track member.

24. The lighting system as described in claim 23 wherein the track member has a substantially U-shaped cross-section and includes first and second leg portions and first and second arm portions, respectively, inwardly extending from the first and second leg portions.

25. The lighting system as described in claim 24 wherein each of the arm portions of the track member supports an electrical conductor.

26. The lighting system as described in claim 24 wherein the track member is made of a polycarbonate material.

27. The lighting system as described in claim 23 wherein the means for supporting each light bulb of the lamp comprises:

a lamp holder for supporting the light bulb and having first and second electrically-conductive prongs;

a body portion having first and second supports for supporting the first and second electrically-conductive prongs, respectively, of the lamp holder;

first and second electrically-conductive plates secured around the first and second supports, respectively;

an insulating cover clip for maintaining the first and second electrically-conductive prongs in electrical contact with the first and second electrically-conductive plates, respectively; and a reflector for directing light away from the light bulb.

28. The lighting system as described in claim 27 wherein the first and second elctrically-conductive plates each include one or more raised contact portions to enable the body portion to be press-fitted into the elongate track member.

* * * * *

UNITED STATES PATENT AND TRADEMARK OFFICE

CERTIFICATE OF CORRECTION

PATENT NO. : 4,845,601

DATED : July 4, 1989

INVENTOR(S) : John A. Podbury and Dennis E. Leech

It is certified that error appears in the above-identified patent and that said Letters Patent is hereby corrected as shown below:

Column 1, line 23, change 'track' to --"track"--.
Column 5, line 36, change 'press-fitted' to --"press-fitted"--.
Column 8, lines 43-44, change "in a press-fit cooperating" to --cooperating in a press-fit--.

Signed and Sealed this

Fifth Day of June, 1990

*Attest:*

HARRY F. MANBECK, JR.

*Attesting Officer*

*Commissioner of Patents and Trademarks*